US011514761B2

(12) United States Patent
Watkins

(10) Patent No.: US 11,514,761 B2
(45) **Date of Patent: *Nov. 29, 2022**

(54) GAMING SYSTEM, METHOD, AND PROGRAM PRODUCT FOR SELECTING GAME SYMBOLS IN A WAGERING GAME

(71) Applicant: Everi Games, Inc., Austin, TX (US)

(72) Inventor: Brian Watkins, Austin, TX (US)

(73) Assignee: Everi Games Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/163,208

(22) Filed: Jan. 29, 2021

(65) Prior Publication Data

US 2021/0192901 A1 Jun. 24, 2021

Related U.S. Application Data

(63) Continuation of application No. 13/627,787, filed on Sep. 26, 2012, now Pat. No. 10,909,817.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/32; G07F 17/326; G07F 17/34
USPC ..... 463/16, 20, 42
See application file for complete search history.

(56) References Cited

U.S. PATENT DOCUMENTS 4,448,419 A * 5/1984 Telnaes ..... G07F 17/3244 463/21
5,085,436 A * 2/1992 Bennett ..... G07F 17/3244 463/21
5,102,137 A * 4/1992 Ekiert ..... G07F 17/3244 273/143 R
5,154,421 A * 10/1992 Hamano ..... G07F 17/3244 463/21
5,263,716 A * 11/1993 Smyth ..... G07F 17/3244 463/21
5,511,784 A * 4/1996 Furry ..... G07F 17/3244 273/143 R
5,938,196 A * 8/1999 Antoja ..... G07F 17/3244 463/20
5,984,781 A * 11/1999 Sunaga ..... G07F 17/3244 463/16
5,988,638 A * 11/1999 Rodesch ..... G07F 17/32 463/20
6,663,487 B1 * 12/2003 Ladner ..... G07F 17/3244 463/20
6,676,510 B1 * 1/2004 Bittman ..... G07F 17/3244 463/20

(Continued)

*Primary Examiner* — Chase E Leichliter
(74) *Attorney, Agent, or Firm* — The Culbertson Group, P.C.; Russell D. Culbertson

(57) ABSTRACT

Multiple different game symbol weighting sets are defined for selection in a given play of a reel-type game. Each game symbol weighting set defines a probability of each reel strip in the reel-type game landing at each particular stop position for that reel strip. By providing multiple different game symbol weighting sets, certain game symbols such as special themed game symbols may be favored for one or more plays of the game to increase the chance of hitting winning symbol combinations using that game symbol.

20 Claims, 7 Drawing Sheets

(56) References Cited

U.S. PATENT DOCUMENTS 6,796,903 B1 * 9/2004 Bryant ..... G07F 17/3244 463/16
8,251,794 B2 * 8/2012 O'Halloran ..... G07F 17/3244 463/16
8,900,048 B2 * 12/2014 Pau ..... G07F 17/32 463/20
10,909,817 B2 * 2/2021 Watkins ..... G07F 17/326
2008/0058067 A1 * 3/2008 Okada ..... G07F 17/3244 463/20
2008/0058072 A1 * 3/2008 Okada ..... G07F 17/3244 463/20
2008/0090633 A1 * 4/2008 Bramble ..... G07F 17/32 463/17
2009/0054129 A1 * 2/2009 Yoshimura ..... G07F 17/32 463/20
2009/0131150 A1 * 5/2009 Iverson ..... G07F 17/3211 463/20
2009/0227365 A1 * 9/2009 Visser ..... G06F 17/00 463/37
2009/0298573 A1 * 12/2009 Bramble ..... G07F 17/3267 463/43
2009/0312086 A1 * 12/2009 Kanellos ..... G07F 17/34 463/20
2010/0029369 A1 * 2/2010 Pacey ..... G07F 17/34 463/43
2010/0124972 A1 * 5/2010 Rodgers ..... G07F 17/34 463/20
2010/0234089 A1 * 9/2010 Saffari ..... G07F 17/34 463/43
2010/0234091 A1 * 9/2010 Baerlocher ..... G07F 17/34 463/43
2012/0115570 A1 * 5/2012 Collette ..... G07F 17/326 463/43
2012/0115599 A1 5/2012 Conway
2013/0310134 A1 * 11/2013 Daeges ..... A63F 13/005 463/20
2014/0087822 A1 * 3/2014 Watkins ..... G07F 17/34 463/20
2021/0192901 A1 * 6/2021 Watkins ..... G07F 17/326

* cited by examiner

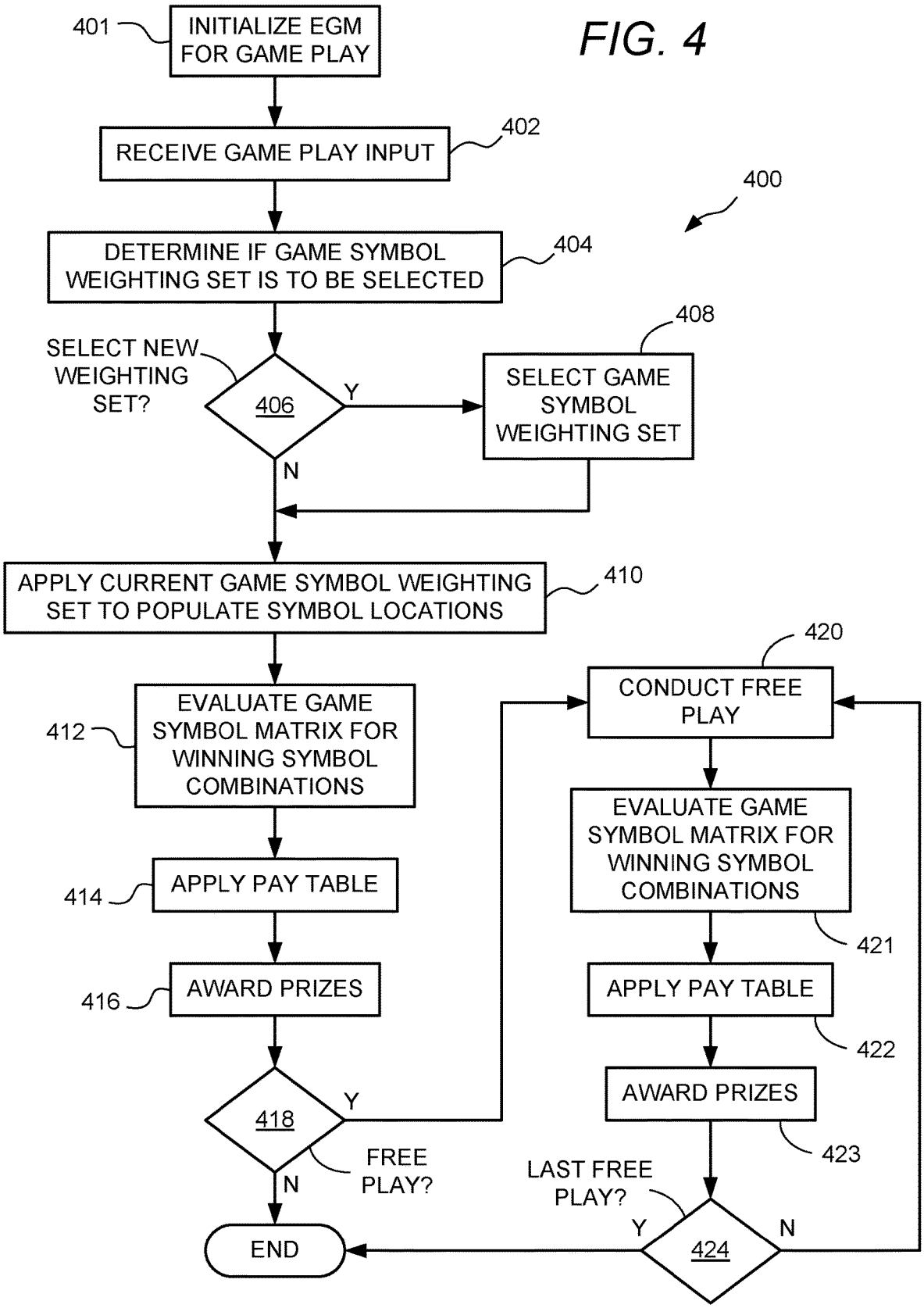
FIG. 4
400
401
INITIALIZE EGM FOR GAME PLAY
402
RECEIVE GAME PLAY INPUT
404
DETERMINE IF GAME SYMBOL WEIGHTING SET IS TO BE SELECTED
SELECT NEW WEIGHTING SET?
406
Y
N
408
SELECT GAME SYMBOL WEIGHTING SET
410
APPLY CURRENT GAME SYMBOL WEIGHTING SET TO POPULATE SYMBOL LOCATIONS
412
EVALUATE GAME SYMBOL MATRIX FOR WINNING SYMBOL COMBINATIONS
414
APPLY PAY TABLE
416
AWARD PRIZES
418
FREE PLAY?
Y
N
END
420
CONDUCT FREE PLAY
EVALUATE GAME SYMBOL MATRIX FOR WINNING SYMBOL COMBINATIONS
421
APPLY PAY TABLE
422
AWARD PRIZES
423
LAST FREE PLAY?
424
Y
N

GAMING SYSTEM, METHOD, AND PROGRAM PRODUCT FOR SELECTING GAME SYMBOLS IN A WAGERING GAME

CROSS-REFERENCE TO RELATED APPLICATIONS

This application is a continuation of U.S. patent application Ser. No. 13/627,787 filed Sep. 26, 2012, and entitled "Gaming System, Method, and Program Product for Selecting Game Symbols In A Wagering Game," to be issued as U.S. Pat. No. 10,909,817. The Applicant hereby claims the benefit of each of this prior U.S. patent application. The entire content of this prior U.S. patent application is incorporated herein by this reference.

BACKGROUND OF THE INVENTION

1. Field of the Invention

The present invention relates to wagering games, gaming machines, gaming systems, program products for such gaming machines and gaming systems, and associated methods. More particularly, the invention relates to the way in which game symbols are selected for wagering games which display results through a matrix of symbol locations which are populated with game symbols for a given play of the game.

2. Description of the Related Art

Numerous types of wagering games have been developed to provide players with new and varied gaming experiences. One of the techniques which has been used to increase player interest in reel-type games (a game which displays results via a number of mechanical or video-generated reels which each carry a reel strip containing a sequence of game symbols) is to employ a number of special game symbols in the reel strips. These special symbols provide for a larger array of winning symbol combinations along the various paylines (symbol location configurations) defined through the matrix of symbol locations produced by the game.

One problem that arises in reel-type games which use a number of additional special game symbols for defining additional winning symbol combinations is that the additional winning symbol combinations may tend to dilute the probabilities of achieving the various winning symbol combinations defined for the game. For example, in a reel-type game which includes five special themed game symbols in addition to a normal group of game symbols (such as an Ace-King-Queen-Jack-ten-nine game symbol set), the probabilities of hitting any winning combinations of those themed game symbols may be undesirably low. That is, these symbol combinations may be achieved so infrequently that players become discouraged.

There remains a need in the field of wagering games to provide gaming machines and methods which capture and maintain the player's interest. In particular, there remains a need in the field of reel-type wagering games to provide interesting game symbols and winning symbol combinations which are achievable at a reasonable rate over the course of play.

SUMMARY OF THE INVENTION

The present invention encompasses methods, apparatus, and program products for varying the manner in which game symbols are selected across different plays of a reel-type wagering game. More specifically, the invention involves defining multiple different game symbol weighting sets for selection in a given play of a game. Each game symbol weighting set defines a probability of each reel strip in the reel-type game landing at each particular stop position for that reel strip. By providing multiple different game symbol weighting sets, certain game symbols such as special themed game symbols may be favored for one or more plays of the game to increase the chance of hitting winning symbol combinations using those game symbols. This increased chance of hitting certain symbols may produce winning combinations using the symbol more often and thereby better hold the player's interest in the game. Yet the various different game symbol weighting sets may all have the same payout percentage to meet regulatory requirements and to maintain a desirable payout and hold for the game.

A method according to some forms of the invention is provided for operating a gaming machine in which at least a first symbol location in a matrix of symbol locations is populated using a first reel strip of a first mechanical or video-generated reel, the first reel strip including a number of stop positions comprising a total number of stop positions from which the at least first symbol location is populated, each stop position containing a respective game symbol available for populating the at least first symbol location. The method includes randomly selecting a game symbol weighting set from a number of game symbol weighting sets stored in a data storage device, the random selection of the game symbol weighting set being performed under control of a system of one or more processing devices. Each game symbol weighting set included in the number of game symbol weighting sets correlates a respective probability with each stop position included on the first reel strip, the respective probability correlated to a respective stop position included on the first reel strip defining a probability for landing at the respective stop position included on the first reel strip for the activation of the first mechanical or video-generated reel. The number of game symbol weighting sets includes a first game symbol weighting set associated with a first target symbol included in a universe of game symbols contained on the first reel strip and available for populating the at least first symbol location. The probability defined by the first game symbol weighting set for landing on the stop position containing the first target symbol is relatively higher than the probability defined by at least one other game symbol weighting set included in the number of game symbol weighting sets for landing on the stop position containing the first target symbol. Under control of the system of one or more processing devices, the method includes applying the selected game symbol weighting set to randomly select a landing stop position for the first mechanical or video-generated reel from among all of the number of stop positions included on the first reel strip. The method includes, for an activation of the first mechanical or video-generated reel, operating the first mechanical or video-generated reel to spin and then come to a stop at the landing stop position to display at the gaming machine the respective game symbol contained on the first reel strip at the landing stop position.

Some methods according to the present invention may also evaluate the game symbol matrix for the presence of any symbol combination defined as a free play combination for the game, and award one or more free plays in the game. The resulting game symbol matrix produced for each free play may be evaluated and a prize awarded for each winning symbol combination. Each of the free plays may be conducted with a game symbol weighting set defined specifically for the free plays, or may be performed with a game symbol weighting set selected in some fashion from different sets of game symbol weightings.

A gaming machine according to one embodiment of the present invention includes a display system including at least one display device, a player input system, and at least one processor, and at least one data storage device storing instructions executable by the at least one processor to select one of the game symbol weighting sets for use in populating the symbol location matrix with game symbols, and to evaluate the resulting game symbol matrix for the presence of winning combinations. The stored instructions may also be executed to evaluate the game symbol matrix for the presence of any free play combinations. Ultimately, the stored instructions are also executed to award a prize for each winning combination produced for the play of the game and for any free plays which may have been conducted.

Considering that the present invention may be implemented using one or more general purpose processing devices, the invention also encompasses a program product which may be stored on one or more tangible computer readable data storage devices representing non-transitory media. The program product may include player input program code, weighting selection program code, and game program code. The player input program code is executable to receive the game play input for a play of the game, while the weighting selection program code is executable to select one of the sets of game symbol weightings as discussed above. The game program code is executable to control the display device for each play of the game and to evaluate the resulting game symbol matrix according to the method described above. In particular, the game program code is executable to cause the display system to display the game symbol matrix using the selected game symbol weighting set, and to evaluate the game symbol matrix for the presence of any winning combination. Payout program code may be included in a program product embodying the principles of the invention and may be executable to award a prize for each winning combination produced in the game symbol matrix.

These and other advantages and features of the invention will be apparent from the following description of illustrative embodiments, considered along with the accompanying drawings.

BRIEF DESCRIPTION OF THE DRAWINGS

FIG. 4 is a flow diagram illustrating a process flow according to one or more embodiments of the present invention.

DESCRIPTION OF ILLUSTRATIVE EMBODIMENTS

In the following description, FIGS. 1-3 will be used to describe example gaming machines and gaming networks through which the present invention may be implemented. Processes which are illustrative of certain embodiments of the invention will then be described in connection with the flow chart of FIG. 4. A reel-type game embodying the principles of the invention will then be described in connection with FIGS. 5-7.

Figure 1:
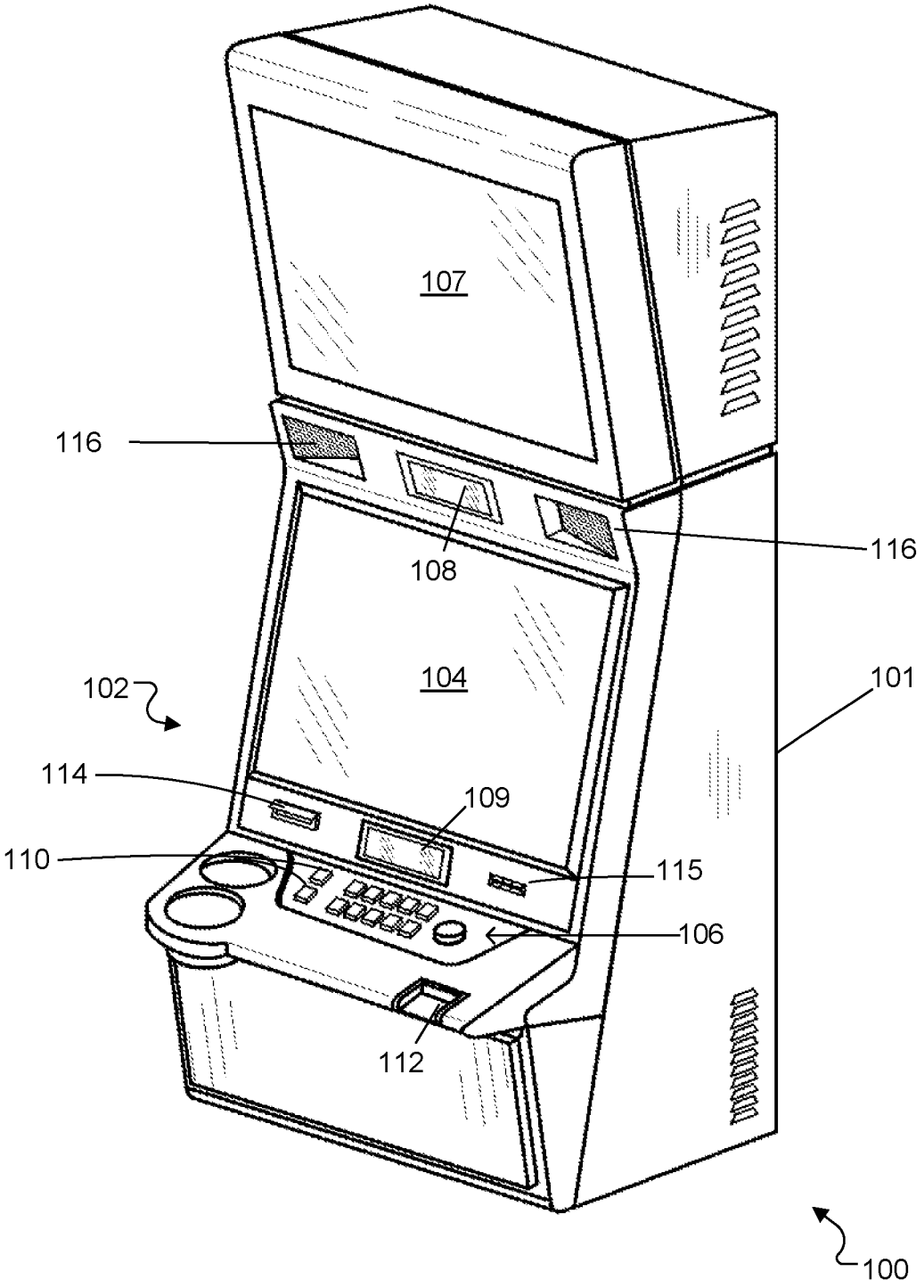
FIG. 1 is a view in perspective of the front of a gaming machine which may be employed in embodiments of the present invention.

FIG. 1 shows a gaming machine 100 that may be used in implementing a game providing game symbol weighting selection according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display game symbols which show the results for a given play of the game implemented through gaming machine 100. Such results may be shown by the manner in which game symbols are aligned along various paylines defined through a symbol location matrix presented by the display device. As will be described further below in connection with FIG. 2 and elsewhere, it is also possible for gaming machines within the scope of the present invention to include mechanical elements such as mechanical reels. Generally, the display device or display devices of the gaming machine, whether video display devices, mechanical devices, or combinations of the two, which are used to display the game symbol matrices according to embodiments of the invention, may be described in this disclosure and the accompanying claims as a display system.

The gaming machine 100 illustrated for purposes of example in FIG. 1 also includes a number of mechanical control buttons 110 mounted on button panel 106. These control buttons 110 may allow a player to select a bet level, select paylines, select a type of game or game feature, and start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls. The player interface devices which receive player inputs to initiate the play of a game through the gaming machine, such as controls to select a wager amount for a given play and controls to actually start a given play, may be referred to generally as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier to provide a desired audio output at the gaming machine.

Figure 2:
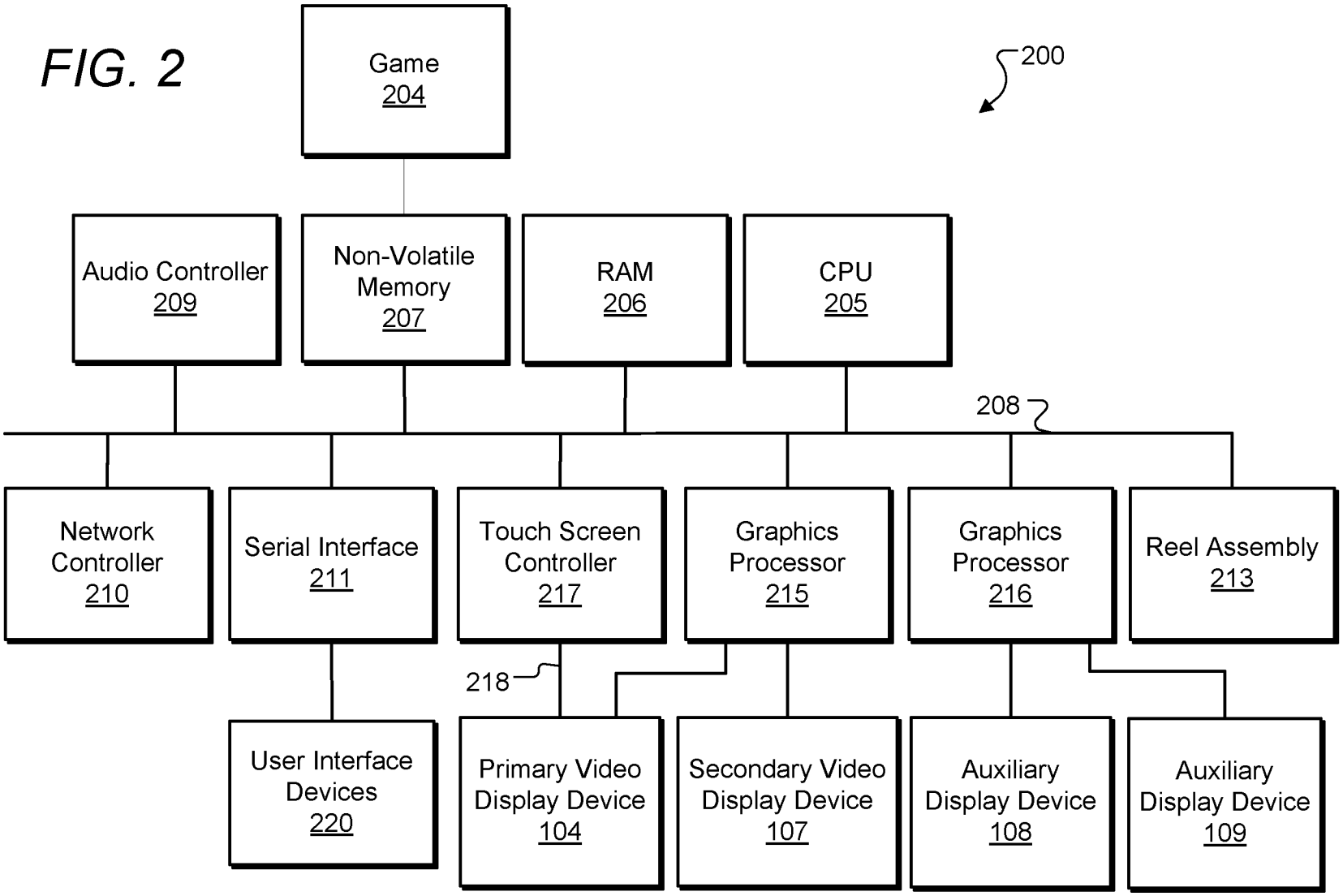
FIG. 2 is a diagrammatic representation of the gaming machine shown in FIG. 1 showing various components of the gaming machine.

FIG. 2 shows a logical and hardware block diagram 200 of gaming machine 100 which includes a central processing unit (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (such as cabinet 101 in FIG. 1). Thus the designation "gaming machine" encompasses both a stand-alone gaming machine and a gaming machine (that is, the part housed in a cabinet such as cabinet 101 in FIG. 1) along with one or more remote components for providing various functions (such as generating outcomes for plays in a game, and driving display devices mounted in a gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as game program code 204 (and associated program code such as player input program code, weighting selection program code, free play program code, and payout program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the invention may include mechanical reels. For example, a set of mechanical reels may replace the primary display device 104, or at least part of that display device. Alternatively, mechanical reels may be included in the gaming machine behind a light-transmissive video display panel. In either case, the mechanical reels represent a display device for displaying some or all of the game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
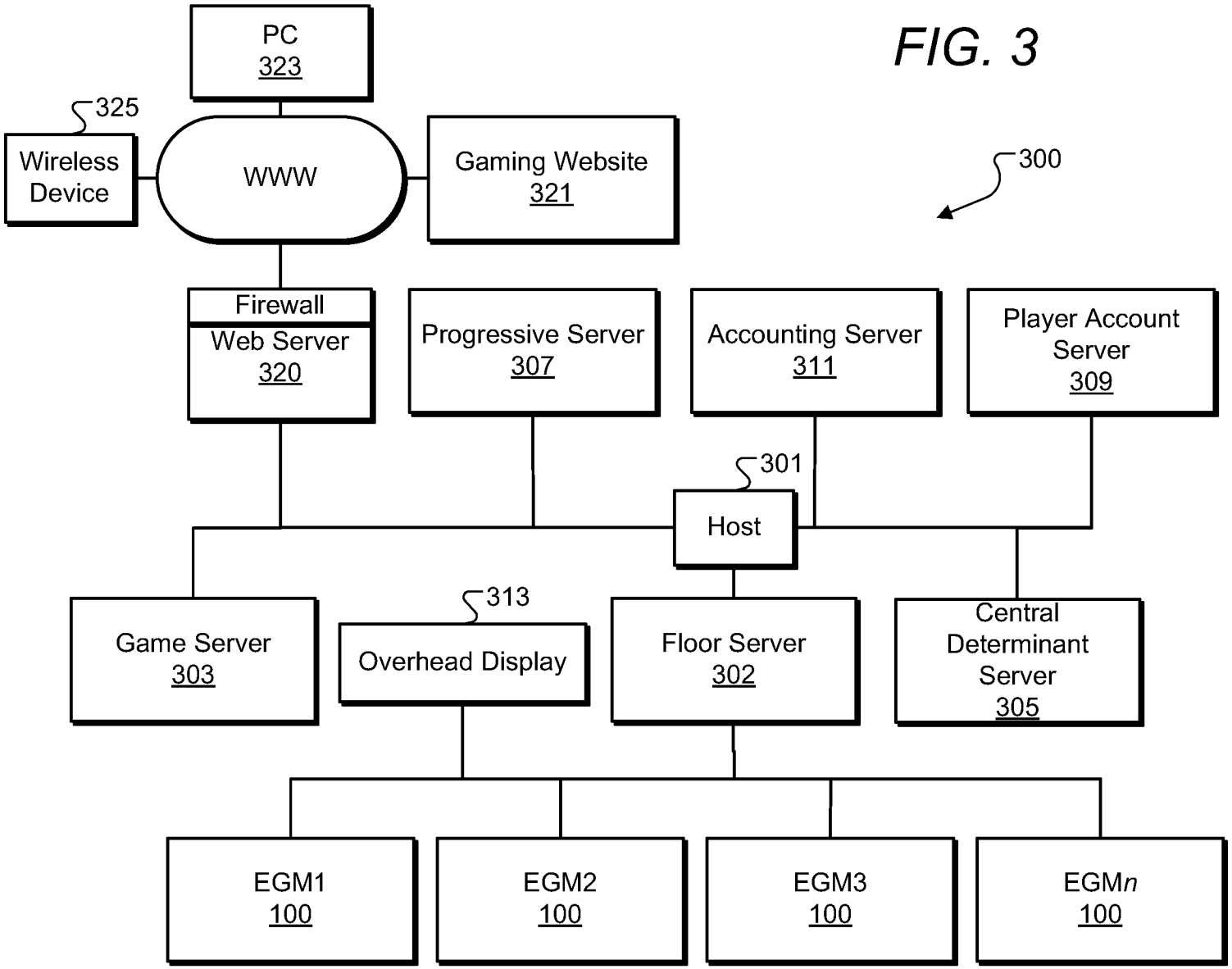
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 may be stored by a display controller or game processor 205 of the given gaming machine and transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the information to networked gaming machines 100 which present the games to players.

Progressive server 307 may accumulate progressive prizes by receiving defined amounts, such as a percentage of the wagers from eligible gaming devices or by receiving funding from marketing or casino funds. Progressive server 307 may also provide progressive prizes to winning gaming devices in response to a progressive event. Such a progressive event may comprise, for example, a progressive jackpot game outcome or other triggering event such as a random or pseudo-random win determination at a networked gaming device or server. Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged onto website 321 the player may play various games on the website. Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which games featuring game symbol weighting selection according to embodiments of the present invention may be implemented, and is not intended to be limiting in any way. The invention is not limited to use in games offered through a gaming network (via the gaming website 321, or via gaming machines such as gaming machines 100, or otherwise). For example, games including game symbol weighting selection according to the present invention may be offered through a stand-alone gaming machine having a configuration similar to gaming machine 100 or having any other gaming machine configuration. Also, where games including game symbol weighting selection as described particularly below in connection with FIGS. 4-7 are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

FIG. 4 illustrates an example process within the scope of the present invention. The process shown in FIG. 4 from process block 402 through 418 represents a single game play sequence according to one form of the invention and thus may be repeated for each respective activation of the game. The following paragraph will describe the overall process shown in FIG. 4 and then subsequent paragraphs will describe the individual process steps in greater detail, and describe certain variations on these steps.

As shown at process block 401, the electronic gaming machine (such as gaming machine 100 in FIGS. 1-3) is first initialized for game play. Once the gaming machine is initialized, the process may include receiving a game play input as indicated at process block 402, and then determining if a game symbol weighting set is to be selected for this current activation of the gaming machine. If no new game symbol weighting set is to be selected as indicated by a negative outcome at decision box 406, the process continues to use the various reel strips defined for the game to populate the matrix of game symbol locations according to the current game symbol weighting set as indicated at process block 410. Otherwise, in the event a game symbol weighting set is to be selected as indicated by an affirmative outcome at decision box 406, the process selects the game symbol weighting set as indicated at process block 408, and then proceeds to the symbol location populating step at process block 410, using the newly selected game symbol weighting set. Once all of the intended symbol locations are populated with a respective game symbol, or at least once the game symbols assigned to the various symbol locations are known, the process evaluates the resulting matrix for the presence of winning combinations of game symbols as indicated at process block 412. In this illustrated example, the process then applies the applicable pay table as indicated at process block 414, and awards prizes defined in the pay table for any detected winning symbol combinations as indicated at process block 416. If no free play winning combination has been detected as indicated by a negative outcome at decision box 418, the process ends. However, if a free play winning combination is detected as indicated by an affirmative outcome at decision box 418, the process branches to conduct the first free play as shown at process block 420, and then evaluates the resulting symbol matrix for winning symbol combinations as indicated at process block 421. The applicable pay table is applied at process block 422 to identify the prize correlated to any winning symbol combination, and any such prize is awarded as shown at process block 423. These four steps at process blocks 420, 421, 422, and 423 are repeated for each free play. If the play on the current cycle through process blocks 420, 421, 422, and 423 is the last free play as indicated by an affirmative outcome at decision box 424, the process then ends for that particular game play sequence. As noted above, the process steps from 402 to 418 (and the branch of process steps 420-424 if free plays are awarded) may be repeated for each subsequent game play input or activation in a gaming session by a player at the gaming machine.

The process of initializing a gaming machine for play of the game as indicated at process block 401 may include a number of different steps depending upon the nature of the gaming machine and the gaming network in which the gaming machine may be included. For example, many modern gaming machines may require a player login to initialize the gaming machine for play. This login may include receiving a player identifier at the game machine in some fashion either through a card reader or other reading device or input device at the gaming machine. Other gaming machines may require no player login, but may require the player to insert cash or credits into the gaming machine in some fashion to initialize the gaming machine for play. For example, in ticket-in-ticket-out systems, a player may be required to insert a ticket into a ticket reader at the gaming machine to place credits on the gaming machine to facilitate play. Where the gaming machine accepts cash, the initialization process may include receiving cash from the player. Process block 401 is included in FIG. 4 simply to indicate that typically the gaming machine must be initialized for game play in some fashion, but is not intended to limit the invention to any particular type of initialization.

In some forms of the invention the process of initializing the gaming machine for play as indicated at process block 401 causes the gaming machine to display a symbol display area on a symbol display device of the gaming machine. The symbol display area includes a number of symbol locations for a wagering game. The state of this symbol display area (that is, the particular game symbols displayed in the symbol locations) may simply be left over from the immediately preceding play of the game. In other embodiments, the state of the symbol display area may be left over from an attract sequence executed by the gaming machine to attract a player to that particular machine. Yet other forms of the invention may return the symbol display area to a particular starting condition for each play of the game.

The game play input received as indicated at process block 402 may include receiving a number of separate inputs to initiate the play of the game. For example, a player may be required to select a bet level for the play and/or may be required to select which symbol location combinations (paylines in reel-type games) are active for the given play. The present invention is not limited to receiving any particular input or inputs to initiate the play of the game. Unless stated specifically otherwise, for the purpose of this disclosure and the following claims, the step of receiving a game play input includes receiving any single input or sequence of inputs to initiate the play of the game.

It will also be appreciated that the process shown in FIG. 4 is not limited to plays in a primary game offered through a gaming machine. Rather, the process may be applied to secondary games, bonus games, and other levels and types of games available through the gaming machine. In cases where game symbol weighting set selection is applied to a bonus game or secondary game which is entered after or during a play in a primary game, and perhaps in other instances, the step of populating the symbol location matrix as indicated at process block 410 may be performed automatically and not in response to a game play input received as indicated at process block 402. Also, a game play input which leads to the process shown at process block 410 may be an input in another game such as a primary game. A primary game in this instance or in other instances may not include game symbol weighting set selection whereas the secondary or bonus game does. That is, different levels of related games at a gaming machine may or may not all include game symbol weighting set selection for a given repopulation of the symbol location matrix.

It should also be noted that the sequence of receiving a game play input as shown at process block 402 in FIG. 4, and determining if a game symbol weighting set is to be selected as indicated at process block 404, is subject to variation within the scope of the present invention. In some implementations, the determination indicated at process block 404 may be performed immediately at the conclusion of the preceding game play sequence, and not after the next game play input. Also, the determination indicated at process block 404 may be performed according to some schedule or otherwise at any point in time rather than in the sequence indicated in the example process shown in FIG. 4.

Other implementations of the present invention may omit the determination step indicated at process block 404. In these implementations, a game symbol weighting set may be selected from the available number of sets for every play of the game. Where the determination as to whether a game symbol weighting set is to be selected is performed, the determination may be made in any suitable fashion. For example, the determination may be made randomly, or randomly according to some probability (such as changing game symbol weighting sets approximately 50% or some other percentage of a total number of game plays). The determination may also be based in whole or in part upon the history of one or more game plays at the gaming machine. For example, it may be desirable to ensure that once a game symbol weighting set has been selected according to some selection rule (randomly from the group of different game symbol weighting sets, for instance), that same game symbol weighting set is used for some minimum number of consecutive plays of the game. After that minimum number of plays, the game symbol weighting set selection may performed again and if a different set is selected, it may be used again for a minimum number of consecutive plays, and so on.

Once it is determined that a game symbol set is to be selected, the selection process shown at process block 408 in FIG. 4 may include any suitable process for selecting one game symbol weighting set from among the available number of such sets. For example, the selection process may ensure that there is an equal chance of any one of the available game symbol weighting sets being selected in the process at process block 408. Alternatively, one or more of the game symbol weighting sets may be more heavily weighted to be selected than the other such sets. One process that may be used at process block 408 involves generating a random number within a certain numerical range, with each available game symbol weighting set correlated to a different numerical subrange to achieve a desired probability of selecting each respective game symbol weighting set. For example, an overall numerical range may be set at 100, with each of four different available game symbol weighting sets correlated to different subranges of 25 within the overall range. A random number within the range of 1-100 should produce a 25% chance of selecting any of the four available game symbol weighting sets in this example.

The process of applying the current game symbol weighting set to populate the symbol locations with respective game symbols according to process block 410 may be accomplished in a number of different ways within the scope of the present invention. Where the gaming machine includes mechanical reels, at least some symbol locations may be populated by spinning the reels and then bringing each reel to a stop to show a respective game symbol at each symbol location. Video reel-type games include a video simulation of reels (which may be shown on video display device 104 in FIG. 1 for example) which spin and then come to a stop to show various game symbols in the symbol location matrix. The invention is not limited to any particular reel arrangement, for either a mechanical reel or video reel implementation. Also, some video-implemented forms of the invention may use the reel strips defined for the game and the selected game symbol weighting set to select the symbols to display for a play of the game without showing the reel actually spinning. The selected game symbols may simply appear in some fashion in the various symbol locations of the matrix.

It should be appreciated that some forms of the invention may not change all of the symbols for given play of the game. For example, one or more of the mechanical or video-generated reels may remain stationary for a given play. Such stationary reels may be selected randomly, may be selected under the control of the player in some fashion, may be selected based on a previous play of the game, or may be selected in any other fashion. Where the player may select symbol locations to remain constant over the course of the given play of the game, the selection may be part of the game play input at process block 402, for example.

The invention is not limited to any particular arrangement for selecting the game symbols to be displayed in the various symbol locations of the symbol location matrix for a given play of the game in accordance with process block 410. Any selection arrangement that selects each game symbol in accordance with the applicable game symbol weighting set may be used within the scope of the invention. As will be discussed further below with FIG. 5, a game symbol weighting set may include a separate weighting for each reel which determines the probability of the reel stopping at a given angular orientation on a given play of the game and thus at a respective game symbol included on the respective reel strip. Alternatively, the same weighting may be used for each reel of the game. In either case the reel weighting may include an overall numeric range made up of a respective numeric subrange for each symbol on the respective reel strip. Each numeric subrange is selected to provide the desired fraction with respect to the overall numeric range. This desired fraction represents the probability of the reel strip landing (stopping) at a stop position or zero position at that reel symbol. For each play of the game, the symbol to display at the stop position or zero position for the given reel may be obtained by generating a random number within the overall numeric range, and then identifying the numeric subrange in which that random number is included. The reel is then controlled to stop showing the reel symbol corresponding to that numeric subrange at the stop position or zero position for the reel.

It should be noted however that although the reel stop position determination technique described in the preceding paragraph represents a preferred technique for causing a reel in a reel-type game to stop in accordance with a game symbol weighting set according to the invention, any other suitable technique may be employed to select game symbols according to the game symbol weighting set in use for the given play of the game. In a central determinant system, such as a central determinant bingo or electronic lottery system, for example, a given play of the game may be associated with one or more outcomes of the underlying game. In these cases, each reel may be forced to stop at the desired angular orientation to display game symbols consistent with the outcome of the underlying game or a random outcome selection. In other forms of the invention the outcome for a given play of the game is obtained in some fashion at the gaming machine itself and the reels are forced to stop showing game symbols consistent with the outcome. In all of these cases, a given game symbol weighting may be enforced in outcome probabilities of the underlying game or outcome generation process, or may be enforced in the manner in which game symbols are selected consistent with the outcome generated or obtained for the given play of the game.

The process of evaluating the game symbol matrix for any winning symbol combinations as shown in process block 412 in FIG. 4 may be accomplished in any suitable fashion. The evaluation may involve comparing the various game symbols in the game symbol matrix to the winning symbol combinations defined in the applicable pay table for the game to determine if a given displayed game symbol matrix matches any of the winning symbol combinations defined in the pay table. The game symbols appearing in the game symbol matrix may be apparent from the angular position of the reel or virtual reel, or may be apparent from the result which forces the reels to stop at the given positions. Alternatively, each winning symbol combination defined in the pay table may be correlated to a set of reel stop positions which produce the symbol combination, and these reel stop positions may be stored in a data table. In this alternative, the evaluation may include comparing the reel stop positions for the game symbol matrix to the stored reel stop positions to identify a match. Such a match indicates that the game symbol matrix produces the winning symbol combinations or combinations correlated to the matched reel stop positions.

The same techniques may be applied to performing the evaluation for winning symbol combinations according to process block 421. However, in the case of process block 421, the applicable pay table may or may not be the same pay table applied in the evaluations indicated at process block 412.

In the example process shown in FIG. 4, it is assumed that at least one winning symbol combination is available which provides the player with one or more free plays in the game in lieu of a cash, credit, or merchandise prize. Such a winning symbol combination may be defined as a combination of one or more symbols scattered across the matrix of symbol locations or as a combination of symbols along a payline. Regardless of how the free plays are triggered, the process at process block 420 may include conducting each free play in response to a free play instruction that may be generated from a player input or may be generated by the program code. In some cases, a number of free plays may be conducted automatically, without requiring any separate player input to initiate any of the free plays and in these cases the program code will produce a free play instruction to initiate each free play. The free plays may be conducted with the same matrix of symbol locations and same universe of game symbols used for the game play which awarded the free plays. Alternatively, the free plays may use a completely different matrix of game symbol locations and/or a different universe of game symbols. Also, it is assumed for the purposes of the example process shown in FIG. 4 that a single game symbol weighting set is used for each free play. This game symbol weighting set may be unique to the free plays. However, it will be appreciated that free plays conducted at process block 420 may also include a step of determining if a game symbol weighting set is to be selected similar to process block 404, and a selection step similar to process block 408 described above.

The process of applying the pay table or pay tables for winning symbol combinations according to process blocks 414 and 422 may involve any suitable process. For example, each winning symbol combination (aside from free play combinations) detected at process blocks 412 and 421 may be associated with a prize value through a suitable data table. In this case, applying the pay table involves reading the associated prize value from the data table and adding that winning prize amount (in the applicable units) to a total amount for that play of the game. This total amount in credits, currency, physical merchandise (or vouchers for such merchandise), or combinations of these or other units may then be awarded to the player in a suitable manner according to the step at process blocks 416 and 423.

The prizes that may be awarded in accordance with process blocks 416 and 423 may be awarded in any particular fashion consistent with the particular gaming machine and gaming system. For example, prizes are awarded in some gaming machines by increasing the credit value on the gaming machine and the player may cash out from that gaming machine to obtain value for those credits. Other types of gaming systems maintain an account for the player's play at a remote accounting system, and the prizes are awarded by crediting the player's remote account and showing the updated account value at the gaming machine. Some types of prizes may be hand pay prizes which require a casino employee to manually deliver the prize or a voucher for the prize to the player. Hand pays are typically required for high-value prizes or for prizes in the form of merchandise or coupons. Other types of gaming machines may physically dispense prizes in the form of coins or other value. The invention is not limited to any particular system or arrangement for awarding the prizes for wins according to the applicable pay table or pay tables for the game.

Figure 5:
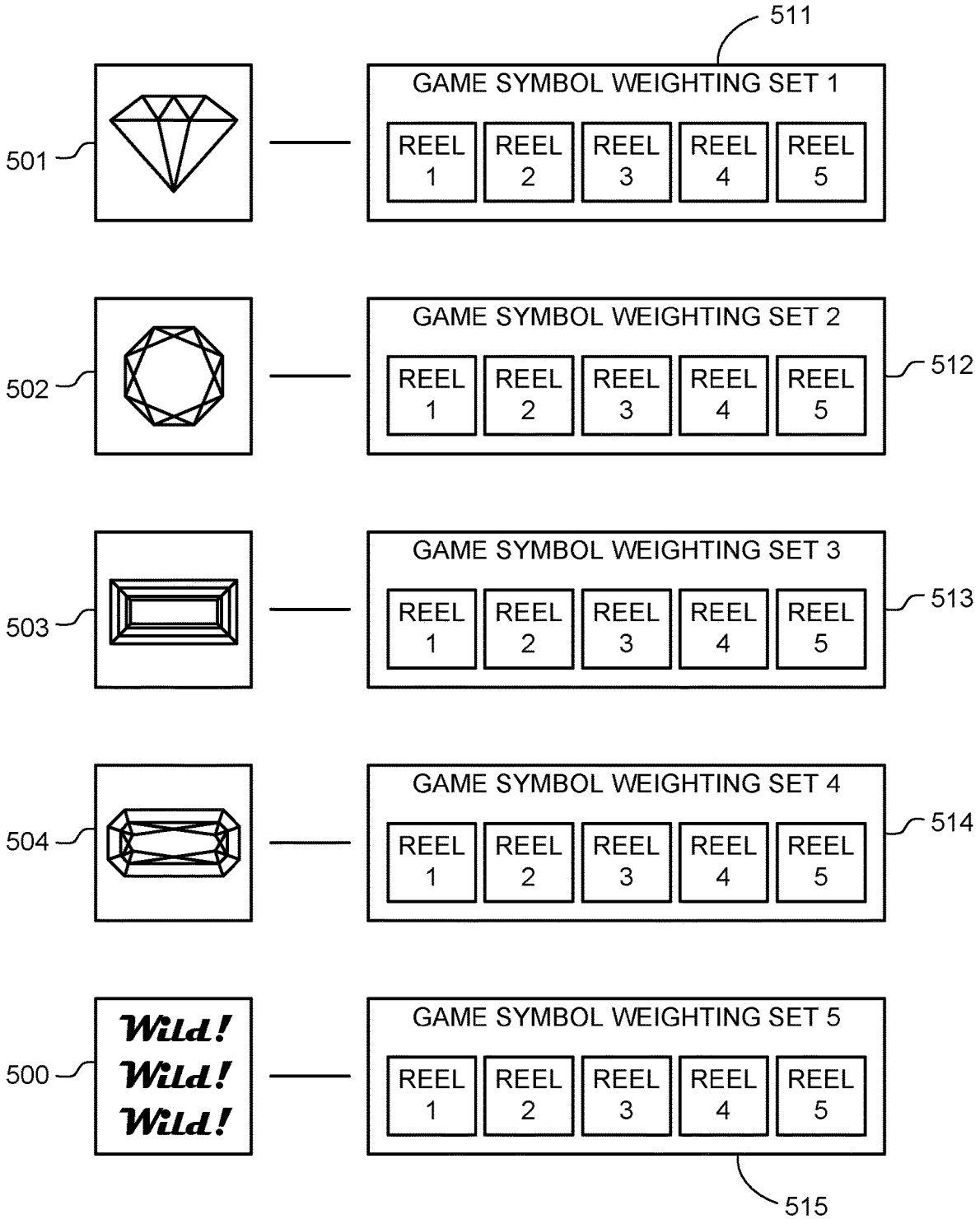
FIG. 5 is a diagrammatic representation showing a relationship between certain game symbols and sets of game symbol weightings that may be used in embodiments of the present invention.
Figure 6:
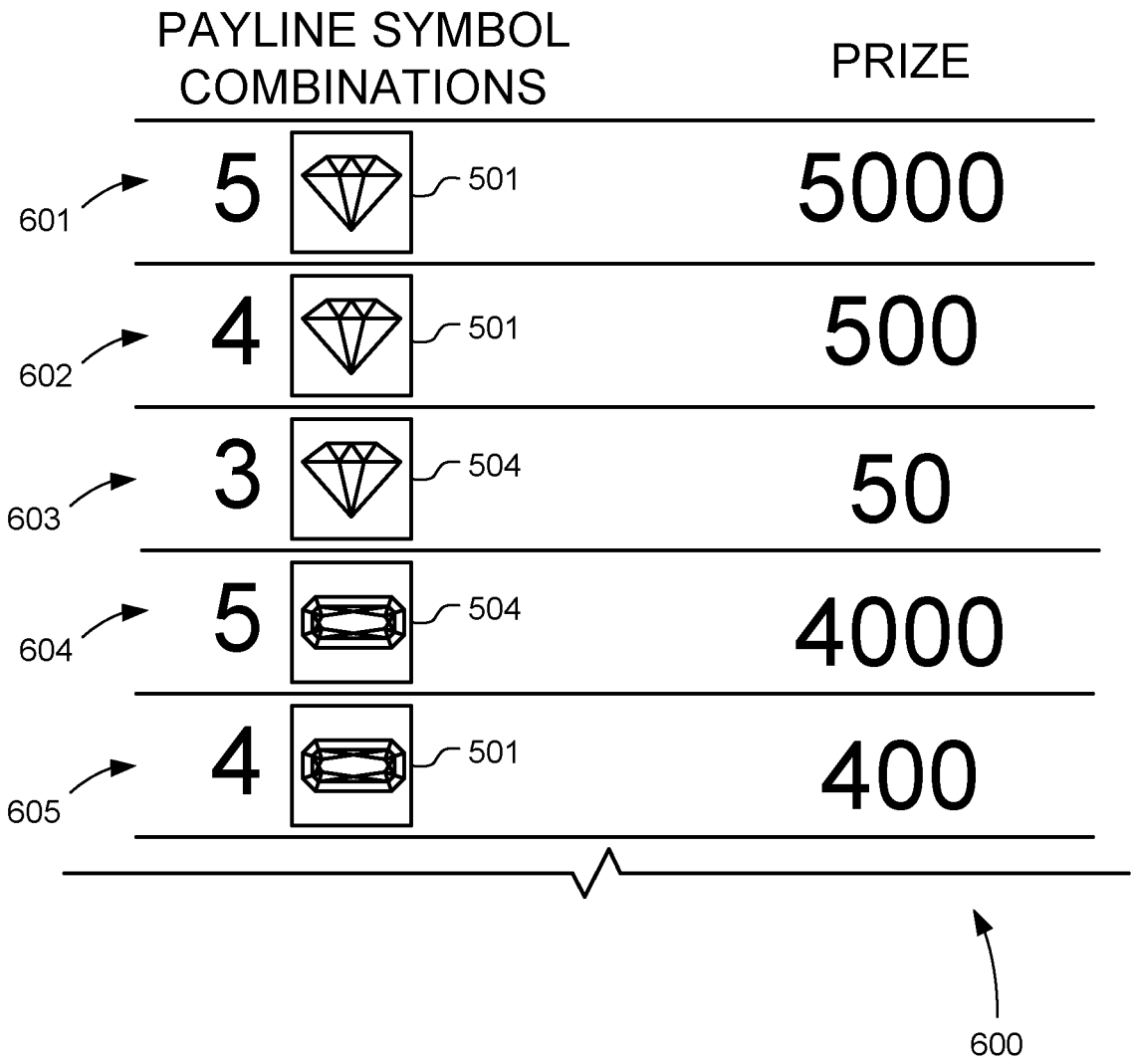
FIG. 6 is a representation of a pay table that may be defined for a game according to the present invention which produces the game symbol matrix shown in FIG. 7.

FIGS. 5 though 7 all relate to a reel-type game which may apply the variable game symbol weighting according to the present invention. FIG. 5 is a diagrammatic representation showing five different game symbol weighting sets from which the selection indicated at process block 408 in FIG. 4 may be made. FIG. 6 comprises a portion of a pay table which may be defined for the reel-type game, and FIG. 7 comprises a representation of a game symbol matrix which may be produced for a play in the reel-type game.

Figure 7:
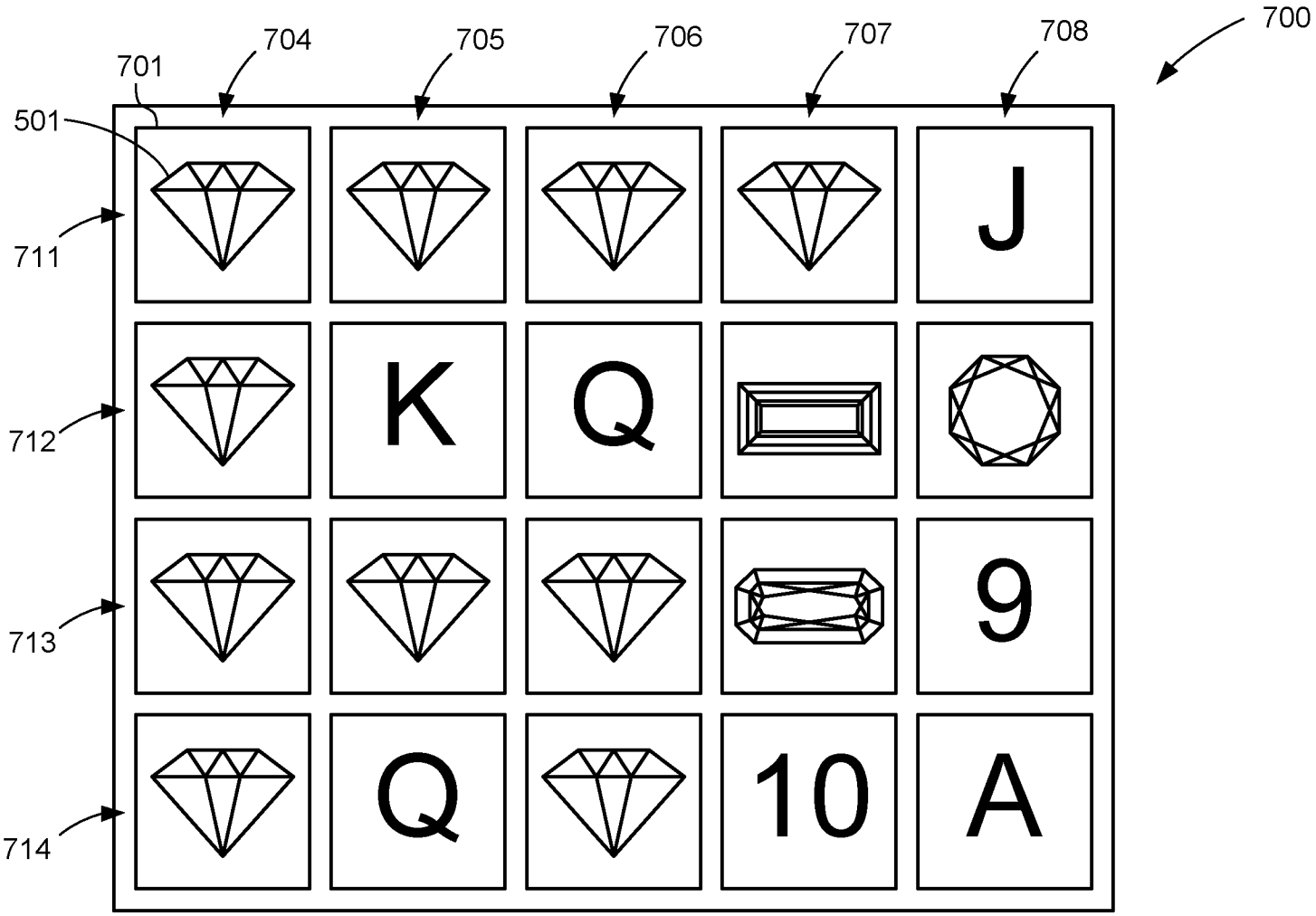
FIG. 7 is a representation of a game symbol matrix that may be formed in an embodiment of the present invention.

For purposes of FIGS. 5 through 7 it should be assumed that the game includes a universe of game symbols including a wild symbol 500, four different gem symbols, a diamond symbol 501, a sapphire symbol 502, an emerald symbol 503, a ruby symbol 504, and (as shown in FIG. 7) the symbols Ace ("A"), King ("K"), Queen ("Q"), Jack ("J"), ten ("10"), and nine ("9"). Although not shown in the drawings, the universe of game symbols may also include a "Free Spin" symbol which may be used to define a win of one or more free spins in the reel-type game. Of course, the invention is by no means limited to this number or these types of game symbols. These symbols simply provide an example to better illustrate the present invention.

Referring to FIG. 5, the example reel-type game employs five different game symbol weighting sets, weighting sets 511-515. Each game symbol weighting set includes a different weighting (designated "REEL 1, REEL 2, and so forth in the figure) for each of the reels which are used to populate the symbol locations as will be described below in connection with FIG. 7. Also, each of the different weighting sets 511-515 is associated with a respective game symbol in that the weighting set weights that particular symbol more heavily than the other special symbols (the gem symbols and the wild symbol). Thus when symbol set 511 is selected in accordance with the process shown at process block 408 in FIG. 4, there will be a higher probability of populating the diamond symbol 501 in at least some of the various symbol locations for the game on any given play. This use of special symbols such as the gem and wild symbols together with the heavier weighting of those symbols in the different game symbol weighting sets 511-515 allows the game to form matching combinations of the special symbols more frequently than any single set of reel weightings could. However, the different game symbol weighting sets 511-515 may all be designed to provide approximately the same payout percentage (within hundredths of a percent, for example). The equivalence of different payout percentages in this regard may be defined in terms of applicable regulatory requirements.

The pay table 600 shown in FIG. 6 includes five lines, lines 601-605 of winning symbol combinations defined for the game. For example, line 601 defines the winning combination of five diamond symbols 501 correlated with a prize of 5000 units, line 602 defines the winning combination of four diamond symbols 501 correlated to the prize of 500 units, and line 605 defines the winning combination of four ruby symbols 504 correlated with the prize of 400 units. It will be appreciated that the pay table continues on with other definitions of winning subset combinations made up of the emerald symbol 503, the sapphire symbol 502, and the playing card-based symbols, however, these additional winning combinations are omitted from FIG. 6, so as not to obscure the present invention in unnecessary detail. Although not shown in the figure, pay table 600 may also include winning symbol combinations which entitle the player to one or more free spins rather than a specific prize.

FIG. 7 shows a matrix 700 of symbol locations 701 for a reel-type game using the above-described universe of game symbols and the example pay table shown in FIG. 6. It may be assumed for purposes of this example that the symbol locations 701 are populated using five reels aligned along a horizontal rotational axis in the orientation of the figure. When in a stop or zero position, each respective reel displays a vertical column of four game symbols. The first reel provides a column 704 of game symbols, the second reel provides column 705, the third reel provides column 706, the fourth reel provides column 707, and the fifth reel provides column 708. The columns of symbol locations are aligned to form four horizontal rows of symbol locations, rows 711-714. This example matrix 700 thus comprises a 4×5 matrix of symbol locations, with each location populated with a respective game symbol. It may be assumed that the paylines for matrix 700 are defined as the four horizontal rows 711-714. The respective reel strips defined for the five reels may all be the same, that is, include the same game symbols in the same sequence, or may each include the game symbols in a different sequence.

The game symbols populating matrix 700 in FIG. 7 may be selected using any of the game symbol weighting sets shown in FIG. 5. However, this particular group of game symbols, which includes a relatively high number of diamond symbols 501, is more likely associated with game symbol weighting set 1 in FIG. 5 because that set is assumed to weight the diamond symbols 501 more heavily than the other special symbols. Regardless of which game symbol weighting set was used to populate the various symbol locations 701, the resulting matrix produced a winning combination of four diamond symbols 501 along the payline comprising row 711 and a winning combination of three diamond symbols 501 along the payline comprising row 713. These winning symbol combinations are shown in pay table 600 in FIG. 6 at lines 602 and 603, and are correlated to prizes of 500 and 50 units, respectively.

It should be noted from FIG. 7 that the reel which produces the first column of symbols, column 704, includes a section of adjacent (stacked) diamond symbols 501 in order to produce the four consecutive vertically aligned diamond symbols shown in this example. The reels, whether video-generated reels or mechanical reels, may include these types of stacked symbols in order to help facilitate producing winning symbol combinations. In particular, for game symbol weightings which favor a given special symbol as shown in FIG. 5, a stacked set of special symbols may be more heavily weighted to land on the first and second reels to favor producing winning combinations of that symbol in the resulting matrix of game symbols.

Implementations of the invention providing variable game symbol weightings are certainly not limited to the examples described above in connection with FIGS. 5 through 7. Rather, embodiments of the invention are subject to wide variation within the scope of the following claims. For example, alternatively to the assumed five-reel, multi-symbol per reel configuration shown in the figures, at least some symbol locations may be shown with a separate reel which populates only that symbol location. In these unisymbol reel arrangements, it will be appreciated that it is not necessary to stack symbols to facilitate the winning symbol combinations such as those described in FIG. 6. Of course, in the case of unisymbol reels, each reel will be stopped according to its own game symbol weighting which may be the same as or different from the weights used for any other unisymbol reels. It is also possible within the scope of the present invention that arrangements other than side-by-side vertically oriented reels may be used to populate the various symbol locations with a respective game symbol. Reels may be arranged to spin about a vertical axis, or spinnable wheels may be arranged to populate the symbol locations in which case the reel strips would be replaced by a series of consecutive wheel segments. Also, arrangements of game symbols that travel in noncircular paths may be used to populate the symbol locations. Of course, embodiments of the invention are not limited to a 4×5 matrix or any particular number of multiple rows and multiple columns.

As noted above, the payout percentage for each game symbol weighting set may be substantially the same in some forms of the invention. However, other embodiments of the invention may include game symbol weighting sets which have different payout percentages. The game symbol weighting set selection technique used at process block 408 in FIG. 4 may be used to favor or disfavor sets having a particular relative payout percentage.

Other variations from the examples of FIGS. 5 through 7 may be associated with the pay table and with the game symbols used to populate the various symbol locations. For example, embodiments of the invention may also include scatter pays which define prizes in terms of some number of symbols or symbol combinations appearing at any of the symbol locations in the matrix, and not just symbol combinations aligned along a payline. Also, the invention is not limited to any symbols or symbol groups. Some implementations may use different symbol groups for populating different symbol locations in the symbol location matrix. For example, rather than a universal set of game symbols such as that described above, some reels of a reel type game may include only a subset of the game symbols used in the game.

Although example implementations of the invention are described above mostly in terms of standalone games, it should be appreciated that the invention may be applied in any number of different gaming environments and/or in combination with other games. For example, games providing variable game symbol weighting according to the present invention may be used as in-revenue or out-of-revenue tournament games or in side action games that are played in parallel or concurrently with one or more other games. Games employing variable game symbol weighting may also be employed as community games in which results at one gaming machine affect a community of one or more other players at different gaming machines. Games employing variable game symbol weighting may also employ additional features to enhance the player's gaming experience. For example, players may be allowed to save game symbols from one play (including trigger symbols) and apply the saved symbols to another play. This may be accomplished by freezing one or more reels for a given play of a reel-type game. Also, games employing variable game symbol weighting may incorporate progressive prizes. For example, one or more prizes in the applicable pay table may comprise a respective progressive prize. Avatars are among other game features which may be used in connection with games employing variable game symbol weighting. For example, an avatar may be used to indicate the selection of a given game symbol weighting set for a play of the game. Trailing touch screen graphic effects such as those disclosed in U.S. Patent Application Publication No. 2012/0115599 may also be incorporated in games employing variable game symbol weighting.

As used in the foregoing description and the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above-described example embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for operating a gaming machine in which at least a first symbol location in a matrix of symbol locations is populated using a first reel strip of a first mechanical or video-generated reel, the first reel strip including a number of stop positions comprising a total number of stop positions from which the at least first symbol location is populated, each stop position containing a respective game symbol available for populating the at least first symbol location, the method including:

(a) randomly selecting a game symbol weighting set from a number of game symbol weighting sets stored in a data storage device, the random selection of the game symbol weighting set being performed under control of a system of one or more processing devices, wherein, (i) each game symbol weighting set included in the number of game symbol weighting sets correlates a respective probability with each stop position included on the first reel strip, the respective probability correlated to a respective stop position included on the first reel strip defining a probability for landing at the respective stop position included on the first reel strip for an activation of the first mechanical or video-generated reel, (ii) the number of game symbol weighting sets includes a first game symbol weighting set associated with a first target symbol included in a universe of game symbols contained on the first reel strip and available for populating the at least first symbol location, (iii) the probability defined by the first game symbol weighting set for landing on the stop position containing the first target symbol is relatively higher than the probability defined by at least one other game symbol weighting set included in the number of game symbol weighting sets for landing on the stop position containing the first target symbol;

(b) under control of the system of one or more processing devices, applying the selected game symbol weighting set to randomly select a landing stop position for the first mechanical or video-generated reel from among all of the number of stop positions included on the first reel strip; and (c) operating the first mechanical or video-generated reel to spin and then come to a stop at the landing stop position to display at the gaming machine the respective game symbol contained on the first reel strip at the landing stop position.

2. The method of claim 1 in which at least one additional symbol location in the matrix of symbol locations is populated using a respective additional reel strip of a respective additional mechanical or video-generated reel, each respective additional reel strip including a number of stop positions comprising a respective total number of stop positions from which the respective additional symbol location is populated, each stop position for the respective additional reel strip containing a respective game symbol available for populating the respective additional symbol location:

(a) wherein each game symbol weighting set included in the number of game symbol weighting sets correlates a respective probability with each stop position included on each respective additional reel strip, the respective probability correlated to a respective stop position included on the respective additional reel strip defining a probability for landing at the respective stop position included on the respective additional reel strip for an activation of the respective additional mechanical or video-generated reel;

(b) under control of the system of one or more processing devices, applying the selected game symbol weighting set to randomly select a respective landing stop position for each respective additional mechanical or video-generated reel from among all of the number of stop positions included on the respective additional reel strip; and (c) under control of the system of one or more processing devices, activating each respective additional mechanical or video-generated reel to spin and then come to a stop at the respective landing stop position selected for the respective additional mechanical or video-generated reel to display at the gaming machine the respective game symbol contained on the respective additional reel strip at the respective landing stop position.

3. The method of claim 2 wherein:

(a) the selected game symbol weighting set includes a first set of stop position weightings which correlates the respective probability with each stop position on the first reel strip and for each additional reel strip a respective additional set of stop position weightings which correlates the respective probability with each stop position on the respective additional reel strip; and (b) each additional set of stop position weightings is unequal to the first set of stop position weightings and is unequal to each other additional set of stop position weightings.

4. The method of claim 2 wherein randomly selecting the game symbol weighing set and applying the game symbol weighting set is performed following randomly obtaining an outcome for a play at the gaming machine.

5. The method of claim 4 wherein randomly selecting the game symbol weighing set and applying the game symbol weighting set is performed consistent with an outcome provided from a central determinant server on a gaming network.

6. The method of claim 1 wherein:

(a) the number of game symbol weighting sets includes at least one additional game symbol weighting set associated with a respective additional target symbol included in the universe of game symbols contained on the first reel strip and available for populating the at least first symbol location; and (b) the probability defined by the respective additional game symbol weighting set for landing on the stop position containing the respective additional target symbol is relatively higher than the probability defined by each other game symbol weighting set included in the number of game symbol weighting sets for landing on the stop position containing the respective additional target symbol.

7. The method of claim 1 wherein each of the number of game symbol weighting sets has approximately the same payout percentage.

8. A gaming machine including:

(a) a display system operable for displaying a result in a game in which at least a first symbol location in a matrix of symbol locations is populated using a first reel strip of a first mechanical or video-generated reel, the first reel strip including a number of stop positions comprising a total number of stop positions from which the at least first symbol location is populated, each stop position containing a respective game symbol available for populating the at least first symbol location;

(b) a player input system;

(c) at least one processor coupled to the gaming machine;

(d) at least one data storage device storing instructions executable by the at least one processor to:

(i) randomly select a game symbol weighting set from a number of game symbol weighting sets stored in the at least one data storage device, the random selection of the game symbol weighting set being performed under control of a system of one or more processing devices, (ii) under control of the system of one or more processing devices, apply the selected game symbol weighting set to randomly select a landing stop position for an activation of the first mechanical or video-generated reel from among all of the number of stop positions included on the first reel strip;

(iii) under control of the system of one or more processing devices, operate the first mechanical or video-generated reel to spin and then come to a stop at the landing stop position to display at the gaming machine the respective game symbol contained on the first reel strip at the landing stop position;

(e) wherein each game symbol weighting set included in the number of game symbol weighting sets correlates a respective probability with each stop position included on the first reel strip, the respective probability correlated to a respective stop position included on the first reel strip defining a probability for landing at the respective stop position included on the first reel strip for the activation of the first mechanical or video-generated reel;

(f) wherein the number of game symbol weighting sets includes a first game symbol weighting set associated with a first target symbol included in a universe of game symbols contained on the first reel strip and available for populating the at least first symbol location; and (g) wherein the probability defined by the first game symbol weighting set for landing on the stop position containing the first target symbol is relatively higher than the probability defined by at least one other game symbol weighting set included in the number of game symbol weighting sets for landing on the stop position containing the first target symbol.

9. The gaming machine of claim 8 wherein:

(a) in the result in the game, at least one additional symbol location in the matrix of symbol locations is populated using a respective additional reel strip of a respective additional mechanical or video-generated reel, each respective additional reel strip including a number of stop positions comprising a respective total number of stop positions from which the respective additional symbol location is populated, each stop position for the respective additional reel strip containing a respective game symbol available for populating the respective additional symbol location;

(b) each game symbol weighting set included in the number of game symbol weighting sets correlates a respective probability with each stop position included on each respective additional reel strip, the respective probability correlated to a respective stop position included on the respective additional reel strip defining a probability for landing at the respective stop position included on the respective additional reel strip for an activation of the respective additional mechanical or video-generated reel; and (c) the instructions are executable by the at least one processor to:

(i) under control of the system of one or more processing devices, apply the selected game symbol weighting set to randomly select a respective landing stop position for the activation of each respective additional mechanical or video-generated reel from among all of the number of stop positions included on the respective additional reel strip, and (ii) under control of the system of one or more processing devices, activate each respective additional mechanical or video-generated reel to spin and then come to a stop at the respective landing stop position selected for the respective additional mechanical or video-generated reel to display at the gaming machine the respective game symbol contained on the respective additional reel strip at the respective landing stop position.

10. The gaming machine of claim 9 wherein:

(a) the selected game symbol weighting set includes a first set of stop position weightings which correlates the respective probability with each stop position on the first reel strip and for each additional reel strip a respective additional set of stop position weightings which correlates the respective probability with each stop position on the respective additional reel strip; and (b) each additional set of stop position weightings is unequal to the first set of stop position weightings and is unequal to each other additional set of stop position weightings.

11. The gaming machine of claim 9 wherein randomly selecting the game symbol weighing set and applying the game symbol weighting set is performed following randomly obtaining an outcome for a play at the gaming machine.

12. The gaming machine of claim 11 wherein randomly selecting the game symbol weighing set and applying the game symbol weighting set is performed consistent with an outcome provided from a central determinant server on a gaming network.

13. The gaming machine of claim 8 wherein:

(a) the number of game symbol weighting sets includes at least one additional game symbol weighting set associated with a respective additional target symbol included in the universe of game symbols contained on the first reel strip and available for populating the at least first symbol location; and (b) the probability defined by the respective additional game symbol weighting set for landing on the stop position containing the respective additional target symbol is relatively higher than the probability defined by each other game symbol weighting set included in the number of game symbol weighting sets for landing on the stop position containing the respective additional target symbol.

14. The gaming machine of claim 8 wherein each of the number of game symbol weighting sets has approximately the same payout percentage.

15. A program product comprising one or more non-transitory computer readable data storage devices storing program code executable by at least one processor, the program code including:

(a) player input program code executable by the at least one processor to receive a game play input entered through a player input system of a gaming machine to initiate a play in a reel-type wagering game in which at least a first symbol location in a matrix of symbol locations is populated using a first reel strip of a first mechanical or video-generated reel, the first reel strip including a number of stop positions comprising a total number of stop positions from which the at least first symbol location is populated, each stop position containing a respective game symbol available for populating the at least first symbol location;

(b) weighting selection program code executable by the at least one processor to randomly select a game symbol weighting set from a number of game symbol weighting sets stored in a data storage device, the random selection of the game symbol weighting set being performed under control of a system of one or more processing devices, wherein, (i) each game symbol weighting set included in the number of game symbol weighting sets correlates a respective probability with each stop position included on the first reel strip, the respective probability correlated to a respective stop position included on the first reel strip defining a probability for landing at the respective stop position included on the first reel strip for an activation of the first mechanical or video-generated reel, (ii) the number of game symbol weighting sets includes a first game symbol weighting set associated with a first target symbol included in a universe of game symbols contained on the first reel strip and available for populating the at least first symbol location, (iii) the probability defined by the first game symbol weighting set for landing on the stop position containing the first target symbol is relatively higher than the probability defined by at least one other game symbol weighting set included in the number of game symbol weighting sets for landing on the stop position containing the first target symbol; and (c) game program code executable by the at least one processor to (i) apply the selected game symbol weighting set to randomly select a landing stop position for the activation of the first mechanical or video-generated reel from among all of the number of stop positions included on the first reel strip, and (ii) operate the first mechanical or video-generated reel to spin and then come to a stop at the landing stop position to display at the gaming machine the respective game symbol contained on the first reel strip at the landing stop position.

16. The program product of claim 15 wherein:

(a) at least one additional symbol location in the matrix of symbol locations is populated using a respective additional reel strip of a respective additional mechanical or video-generated reel, each respective additional reel strip including a number of stop positions comprising a respective total number of stop positions from which the respective additional symbol location is populated, each stop position for the respective additional reel containing a respective game symbol available for populating the respective additional symbol location;

(b) each game symbol weighting set included in the number of game symbol weighting sets correlates a respective probability with each stop position included on each respective additional reel strip, the respective probability correlated to a respective stop position included on the respective additional reel strip defining a probability for landing at the respective stop position included on the respective additional reel strip for an activation of the respective additional mechanical or video-generated reel; and (c) the game program code is also executable to:

(i) apply the selected game symbol weighting set to randomly select a respective landing stop position for the activation of each respective additional mechanical or video-generated reel from among all of the number of stop positions included on the respective additional reel strip, and (ii) activate each respective additional mechanical or video-generated reel to spin and then come to a stop at the respective landing stop position selected for the respective additional mechanical or video-generated reel to display at the gaming machine the respective game symbol contained on the respective additional reel strip at the respective landing stop position.

17. The program product of claim 16 wherein:

(a) the selected game symbol weighting set includes a first set of stop position weightings which correlates the respective probability with each stop position on the first reel strip and for each additional reel strip a respective additional set of stop position weightings which correlates the respective probability with each stop position on the respective additional reel strip; and (b) each additional set of stop position weightings is unequal to the first set of stop position weightings and is unequal to each other additional set of stop position weightings.

18. The program product of claim 16 wherein randomly selecting the game symbol weighing set and applying the game symbol weighting set is performed following randomly obtaining an outcome for a play at the gaming machine.

19. The program product of claim 18 wherein randomly selecting the game symbol weighing set and applying the game symbol weighting set is performed at a central determinant server on a gaming network.

20. The program product of claim 15 wherein:

(a) the number of game symbol weighting sets includes at least one additional game symbol weighting set associated with a respective additional target symbol included in the universe of game symbols contained on the first reel strip and available for populating the at least first symbol location; and (b) the probability defined by the respective additional game symbol weighting set for landing on the stop position containing the respective additional target symbol is relatively higher than the probability defined by each other game symbol weighting set included in the number of game symbol weighting sets for landing on the stop position containing the respective additional target symbol.

* * * * *